US010948228B2

(12) United States Patent
Wang et al.

(10) Patent No.: US 10,948,228 B2
(45) Date of Patent: Mar. 16, 2021

(54) AIR DUCT ASSEMBLY AND REFRIGERATOR

(71) Applicant: MIDEA GROUP CO., LTD., Foshan (CN)

(72) Inventors: Yaodong Wang, Foshan (CN); Haibin Zhang, Foshan (CN); Nanfei Yao, Foshan (CN); Hui Zhang, Foshan (CN); Jizhe Zhang, Foshan (CN); Lele Ming, Foshan (CN); Xiaokang Peng, Foshan (CN); Yuan Lan, Foshan (CN); Chubin Ou, Foshan (CN)

( * ) Notice: Subject to any disclaimer, the term of this patent is extended or adjusted under 35 U.S.C. 154(b) by 211 days.

(21) Appl. No.: 16/228,747

(22) Filed: Dec. 20, 2018

(65) Prior Publication Data

US 2019/0128588 A1 May 2, 2019

Related U.S. Application Data

(63) Continuation of application No. PCT/CN2017/082530, filed on Apr. 28, 2017.

(30) Foreign Application Priority Data

Feb. 15, 2017 (CN) ..... 201710080405.4

(51) Int. Cl.
*F25D 17/08* (2006.01)
*F25D 17/06* (2006.01)

(52) U.S. Cl.
CPC ..... *F25D 17/062* (2013.01); *F25D 17/08* (2013.01); *F25D 2317/063* (2013.01);
(Continued)

(58) Field of Classification Search
CPC ..... F25D 2317/067; F25D 2317/0671; F25D 2317/0672; F25D 2317/063
See application file for complete search history.

(56) References Cited

U.S. PATENT DOCUMENTS 5,775,124 A * 7/1998 Park ..... F25D 17/045 62/408
5,778,694 A * 7/1998 Jeong ..... F25D 17/045 62/187

(Continued)

FOREIGN PATENT DOCUMENTS

CN 201532067 U 7/2010
CN 201731713 U 2/2011

(Continued)

OTHER PUBLICATIONS

International Search Report dated Nov. 21, 2017 in the corresponding PCT application(application No. PCT/CN2017/082530).

(Continued)

*Primary Examiner* — Filip Zec
(74) *Attorney, Agent, or Firm* — Kilpatrick Townsend & Stockton, LLP

(57) ABSTRACT

The present disclosure provides an air duct assembly of a refrigerator, comprising: a main body, the main body being provided with an air inlet toward one side of the main body, a plurality of air outlets formed in areas of two sides of the main body, and an air-uniformizing partition plate provided on the main body and located above the air inlet, and the air-uniformizing partition plate divides the air entered from the air inlet into the areas of two sides of the main body and the air is discharged via the plurality of air outlets.

14 Claims, 8 Drawing Sheets

(52) U.S. Cl.
CPC ..... *F25D 2317/067* (2013.01); *F25D 2317/0662* (2013.01); *F25D 2317/0665* (2013.01); *F25D 2317/0671* (2013.01); *F25D 2317/0672* (2013.01)

(56) References Cited

U.S. PATENT DOCUMENTS

| | | | | |
|---|---|---|---|---|
| 5,992,165 | A * | 11/1999 | Kim | F25D 17/045 62/187 |
| 6,637,225 | B1 * | 10/2003 | Cho | F25D 17/045 236/49.3 |
| 2005/0217307 | A1 * | 10/2005 | Kim | F25D 23/061 62/408 |
| 2010/0300137 | A1 * | 12/2010 | Lim | F25D 17/065 62/419 |
| 2011/0011106 | A1 * | 1/2011 | Ahn | F25D 17/065 62/89 |
| 2011/0259896 | A1 * | 10/2011 | Bai | F25D 17/065 220/592.02 |
| 2014/0220880 | A1 * | 8/2014 | Kim | F25D 17/065 454/329 |

FOREIGN PATENT DOCUMENTS

| | | | |
|---|---|---|---|
| CN | 102080909 | A | 6/2011 |
| CN | 202692580 | U | 1/2013 |
| CN | 103471310 | A | 12/2013 |
| CN | 104534779 | A | 4/2015 |
| CN | 105157311 | A | 12/2015 |
| CN | 205014739 | U | 2/2016 |
| CN | 205536791 | U | 8/2016 |
| JP | 2001091127 | A | 4/2001 |
| JP | 2001165551 | A | 6/2001 |
| JP | 2011191028 | A | 9/2011 |
| WO | 2011110648 | A2 | 9/2011 |
| WO | 2016025445 | A1 | 2/2016 |
| WO | 2016199487 | A1 | 12/2016 |

OTHER PUBLICATIONS

The extended European search report dated Jun. 24, 2019 in the corresponding European Application No. 17896835.0.
The Office Action of JP 2019-520186.

* cited by examiner

AIR DUCT ASSEMBLY AND REFRIGERATOR

CROSS-REFERENCES TO RELATED APPLICATIONS

This application is continuation of International Application No. PCT/CN2017/082530, filed on Apr. 28, 2017, which claims the priority to Chinese patent application No. 201710080405.4, filed with the Chinese Patent Office on Feb. 15, 2017, and entitled "AIR DUCT ASSEMBLY AND REFRIGERATOR, all of which are incorporated herein by reference in their entirety.

FIELD

The present disclosure relates to the field of household appliances, and in particular to an air duct assembly and a refrigerator.

BACKGROUND OF THE INVENTION

For refrigerators and other refrigeration products, there is a common problem: the internal temperature of the refrigerator is uneven, and there are two main reasons for the temperature unevenness: one is heat losses; the other is uneven flow of an air supply port.

At present, the cooling capacity inside the refrigerator is in the form of cold air which flows through the evaporator and is transported to various functional areas via the air duct. In this process, there are two parts of losses in the cooling capacity transported. One is the loss from the air duct, and the other is the heat loss caused by heat exchange with the wall after the cooling capacity enters the refrigerator. The uneven flow of the air supply port is caused by the unreasonable design of the air duct structure. A common problem is that there is uneven flow among different air supply ports on the left and right sides of the refrigerator, as well as the total air volume on the left and right sides of the refrigerator. This causes the cooling capacity carried by the cold air on the two sides to be inconsistent, resulting in uneven temperature inside the refrigerator body. Uneven temperature can adversely affect the food being stored, reducing the shelf life of the food, thereby seriously damaging the user's experience. Due to the size and internal functional structure, most of the air ducts are asymmetric. This will also result in uneven distribution of flow, resulting in temperature fluctuations and temperature differences, and causing many problems such as follows:

Disadvantage 1: Due to the asymmetric air duct structure, the air supply volume of each branched flow channel is uneven, resulting in a temperature difference inside the refrigerator;

Disadvantage 2: Due to the asymmetric air duct structure, the flow among symmetric air supply ports of each branched flow channel are uneven, resulting in a temperature difference inside the refrigerator;

Disadvantage 3: Due to the asymmetric air duct structure, an unreasonable air supply duct design will lead to increased flow resistance and obvious temperature fluctuations.

Disadvantage 4: Due to the asymmetric air duct structure, it is easy to generate aerodynamic noise.

BRIEF SUMMARY OF THE INVENTION

One embodiment of the present disclosure is an air duct assembly.

Another embodiment of the present disclosure, a refrigerator is also provided.

In this regard, according to an embodiment of the present disclosure, there is provided in the present disclosure an air duct assembly, comprising: a main body, the main body being provided with an air inlet toward one side of the main body; a plurality of air outlets formed in areas of two sides of the main body; and an air-uniformizing partition plate provided on the main body and located above the air inlet, and the air-uniformizing partition plate divides the air entered from the air inlet into the areas of two sides of the main body and the air is discharged via the plurality of air outlets.

According to the air duct assembly provided in the present disclosure, by arranging the air-uniformizing partition plate above the air inlet, the air entered from the air inlet on one side of the main body can be evenly divided to both sides of the air duct assembly by the air-uniformizing partition plate and the air is discharged via the air outlets. Due to an asymmetrical structure of the air duct, the inlet air is uniformly divided into the air outlets on both sides by providing the air-uniformizing partition plate. Generally, the air outlet communicates with an inner liner (refrigeration compartment) of the refrigerator, so that air volumes at the air inlets on both sides of the refrigeration compartment are evenly distributed, which reduces temperature differences among different parts, reduces the occurrence of temperature fluctuations, and effectively reduces the flow resistance loss and aerodynamic noise, realizing greater flow at the same fan rotating speed. A top end of the air-uniformizing partition plate may be a multi-section arc chamfer structure for further reducing aerodynamic resistance.

In addition, the air duct assembly in the above embodiment provided in the present disclosure may further have the following additional features:

In one embodiment, the plurality of air outlets comprises: a first air outlet, which is provided on a side of the main body closer to the air inlet; a second air outlet, which is provided at a top of the main body closer to the air inlet; a third air outlet, which is provided on a side of the main body farther from the air inlet; a fourth air outlet, which is provided at a top of the main body farther from the air inlet; and an deflecting plate, which is provided on the main body and located between the third air outlet and the air-uniformizing partition plate, and the deflecting plate divides the inlet air farther from the air inlet into the third air outlet and the fourth air outlet.

In one embodiment, air outlets are each provided on the side and the top of two sides of the main body to ensure a more uniform air outlet for the refrigeration compartment, which is convenient to improve the cooling efficiency of a refrigeration device and avoid the temperature difference in the refrigeration compartment. At the same time, by providing the deflecting plate, the air flowing to the third air outlet and the fourth air outlet on the far side of the air inlet is divided to ensure a more uniform flow of the air flowing through the third air outlet and the fourth air outlet, further avoiding the temperature difference in the refrigeration compartment, and also reducing air flow resistance loss and aerodynamic noise during the air dividing. This can improve the cooling capacity and uniformity of the refrigeration unit, while also reducing noise and improving the user experience.

In one embodiment, the air-uniformizing partition plate is provided with a round corner at a bottom of a side close to the third air outlet.

In one embodiment, by providing the curved corner at the bottom of the air-uniformizing partition plate on the side close to the third air outlet, the airflow can smoothly flow through the curved corner area when flowing to the side of the third air outlet. Therefore, the flow loss caused by the sudden change of air current is reduced, the occurrence unnecessary eddy current is reduced, the uniformity of air flowing to the third air outlet and the fourth air outlet is improved, and local temperature fluctuation is avoided.

In one embodiment, the air-uniformizing partition plate is provided with a wavelike structure or a zigzag structure on a side close to the third air outlet.

In one embodiment, generally, when the airflow encounters a curve, the flow direction changes, which will not only cause loss due to resistance, but also generate vortexes. However, by using the deflecting plate in combination with the wavelike structure or the zigzag structure, the airflow loss can be effectively reduced. The wavelike structure or the zigzag structure can prevent a reverse airflow caused by the pressure difference, thereby avoiding the increase of resistance caused by the reverse airflow and the reduction of effective flow, reducing some of the noise caused by airflow vibrations, increasing the uniformity and effectiveness of the airflow, also increasing the amount of airflow that flows out the air outlet, so that the cooling efficiency is improved and energy saved.

In one embodiment, the third air outlet comprises: a third upper air outlet, provided at an upper portion of a side of the main body farther from the air inlet; a third middle air outlet, provided at a middle portion of a side of the main body farther from the air inlet; and a third lower air outlet, provided at a lower portion of a side of the main body farther from the air inlet.

In one embodiment, the third air outlet comprises three air outlets at the upper, middle and lower sides of the side farther from the air inlet. By providing the upper, middle and lower air outlets, air discharge flow at each air outlet can be more uniform, and local temperature difference and temperature fluctuation are avoided; and for the refrigeration compartment connected to the air outlet, a more uniform cooling effect can be obtained, so that the air temperature at each position inside the refrigeration compartment is kept substantially the same, the temperature fluctuation is suppressed, and the local temperature difference is avoided.

In one embodiment, the bottom of the third upper air outlet is provided with a first air guiding slope, and an angle between the first air guiding slope and the horizontal plane ranges from 20° to 45°.

In one embodiment, the first air guiding slope is provided at the bottom of the third upper air outlet to divide the air at the third upper air outlet, thereby reducing inlet resistance loss and increasing outlet air volume. Further, the outlet air volume at each air outlets is more uniform, the cooling effect is more uniform, the local temperature difference is avoided, and the temperature fluctuation is eliminated.

In one embodiment, a distance between the third upper air outlet and the third middle air outlet ranges from 50 mm to 150 mm; a distance between the third lower air outlet and the third middle air outlet ranges from 50 mm to 150 mm.

In one embodiment, by providing a positional relationship among the third upper air outlet, the third middle air outlet, and the third lower air outlet, the airflow passing through the air duct assembly can smoothly flow out from the air outlets at corresponding positions, thereby improving the efficiency of air flow and reducing pressure loss.

In one embodiment, the first air outlet comprises: a first upper air outlet, provided at an upper portion of a side of the main body closer to the air inlet; a first middle air outlet, provided at a middle portion of a side of the main body closer to the air inlet; and a first lower air outlet, provided at a lower portion of a side of the main body closer to the air inlet.

In one embodiment, the first air outlet comprises three air outlets at the upper, middle and lower sides of the side farther from the air inlet. By providing the upper, middle and lower air outlets, air discharge flow at each air outlet can be more uniform, and local temperature difference and temperature fluctuation are avoided; and for the refrigeration compartment connected to the air outlet, a more uniform cooling effect can be obtained, so that the air temperature at each position inside the refrigerating compartment is kept substantially the same, the temperature fluctuation is suppressed, and the local temperature difference is avoided.

In one embodiment, the bottom and the top of the first middle air outlet are each provided with a second air guiding slope, and an angle between the second air guiding slope and the horizontal plane ranges from 20° to 30°. The bottom and the top of the first lower air outlet are each provided with a third air guiding slope, and an angle between the third air guiding slope and the horizontal plane ranges from 20° to 30°.

In one embodiment, the first air guiding slope is provided at the first middle air outlet and the bottom and top of the first lower air outlet to guide the air at the first middle air outlet and the first lower air outlet, thereby increasing outlet air volume. Further, the outlet air volume at each air outlets is more uniform, the cooling effect is more uniform, the local temperature difference is avoided, and the temperature fluctuation is eliminated.

In one embodiment, a distance between the first upper air outlet and the first middle air outlet ranges from 50 mm to 150 mm; and a distance between the first lower air outlet and the first middle air outlet ranges from 50 mm to 150 mm.

In one embodiment, by providing a positional relationship among the third upper air outlet, the first middle air outlet, and the first lower air outlet, the airflow passing through the air duct assembly can smoothly flow out from the air outlets at corresponding positions, thereby improving the efficiency of air flow and reducing pressure loss. In one embodiment, a thickness of the deflecting plate ranges from 5 mm to 12 mm.

In one embodiment, by providing the deflecting plate of a suitable thickness, the airflow can be well guided, making the flow at each air outlet more uniform, and the resistance of the airflow will not be increased by the excessive thickness, which affects the airflow. Generally, a thickness of the deflecting plate can be selected from 5 mm to 12 mm, and the thickness of the deflecting plate can be adjusted according to the actual structure of the air duct and the airflow.

In one embodiment, the thickness of the air-uniformizing partition plate ranges from 5 mm to 12 mm; and the ratio of the thickness of the air-uniformizing partition plate to a cross-sectional width of the air inlet ranges from 5% to 15%.

In one embodiment, by providing the air-uniformizing partition plate of a suitable thickness, the airflow can be well divided, making the flow at each air outlet more uniform, and the resistance of the airflow will not be increased by the excessive thickness, which affects the airflow. Generally, the thickness of the air-uniformizing partition plate can be selected from 5 mm to 12 mm or 5% to 15% of the cross-sectional width of the air inlet. In this way, the diversion of the inlet air at the air inlet can be achieved without causing a relatively large resistance to the airflow, and in practical applications, the thickness of the air-uniformizing partition plate can also be adjusted according to the actual structure of the air duct and the airflow.

The air duct assembly provided by the disclosure can be used as a structural design scheme for an asymmetric air duct. By using the air-uniformizing partition plate and the deflecting plate, combined with the wavelike or zigzag structure, the cold air can be evenly distributed to air supply ducts on the left and right sides, meanwhile the air volume at corresponding air outlets on the left and right sides can be kept consistent, reducing vortex flow and counter flow of cold air inside the air duct, ensuring that the air temperature at each position inside the refrigerator is kept substantially the same, and temperature fluctuations are suppressed.

The refrigerator provided by one of the embodiments of the present disclosure comprises the air duct assembly of embodiments.

The refrigerator provided in the present disclosure adopts the air duct assembly of the embodiments of the present disclosure Generally, the air outlet communicates with an inner liner (refrigeration compartment) of the refrigerator, so that air volumes at the air inlets on both sides of the refrigeration compartment are evenly distributed, which reduces temperature differences among different parts, reduces the occurrence of temperature fluctuations, and effectively reduces the flow resistance loss and aerodynamic noise, realizing greater flow at the same fan rotating speed, improving the efficiency of the refrigerator and saving energy.

In addition, the refrigerator in the above embodiment provided in the present disclosure may further have the following additional features:

In one embodiment, the refrigerator further comprises: a fan assembly, the fan assembly being connected to the air duct assembly.

In one embodiment, the low temperature air flowing out of the fan assembly flows uniformly to each air outlet through the air duct assembly, which reduces pressure loss and aerodynamic noise, and achieves a better cooling effect under the condition that the fan assembly has a certain amount of air supply.

In one embodiment, the refrigerator further comprises: a refrigeration compartment, the refrigerating compartment being connected to the plurality of air outlets.

In one embodiment, the low temperature air flowing out through the plurality of air outlets flows into the refrigeration compartment, and by adopting the above air duct assembly, the air inlet in the refrigeration compartment is more uniform, and the uniform cooling in the compartment is ensured, avoiding local temperature rise caused by uneven airflow and thus affect food storage.

BRIEF DESCRIPTION OF THE DRAWINGS

Embodiments of the present disclosure will become apparent by describing the embodiments thereof with reference to the accompanying drawings, in which.

Figure 1:
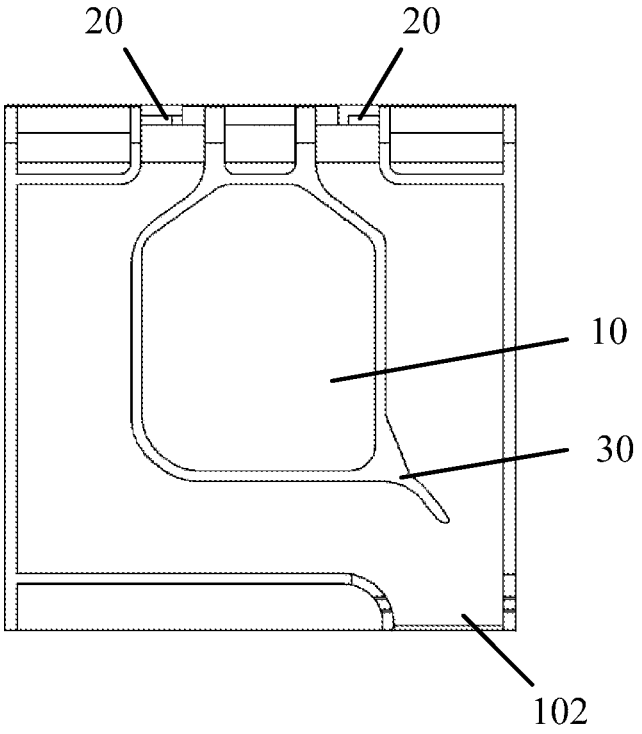
FIG. 1 is a schematic structural view of a cooking device in an embodiment of the present disclosure.

The correspondence between the reference numerals and the component names in FIG. 1 to FIG. 8 is as follows:

10 main body, 102 air inlet, 20 air outlet, 202 first air outlet, 2022 first upper air outlet, 2024 first middle air outlet, 2026 first lower air outlet, 204 second air outlet, 206 third air outlet, 2062 third upper air outlet, 2064 third central air outlet, 2066 third lower air outlet, 208 fourth air outlet, 30 air-uniformizing partition plate, 302 round corner, 304 wavelike structure, 40 deflecting plate, 5 refrigerator, 52 front cover assembly, 54 rear cover assembly, 56 fan assembly, 58 compressor compartment, 60 control display screen.

DETAILED DESCRIPTION OF THE INVENTION

To enable the above objects, features and advantages of the present disclosure better understood, the disclosure will be further described in detail with the accompanying drawings and embodiments.

It should be noted that the embodiments and the characteristics of the embodiments can be combined if no conflict is caused.

In the following description, numerous specific details are set forth in order to provide a thorough understanding of the disclosure. However, the present disclosure may be embodied in other specific forms than those described herein. Therefore, the scope of the present disclosure is not limited by the embodiments disclosed below.

An air duct assembly and a refrigerator according to some embodiments of the present disclosure will be described with reference to FIG. 1 to FIG. 8.

Figure 2:
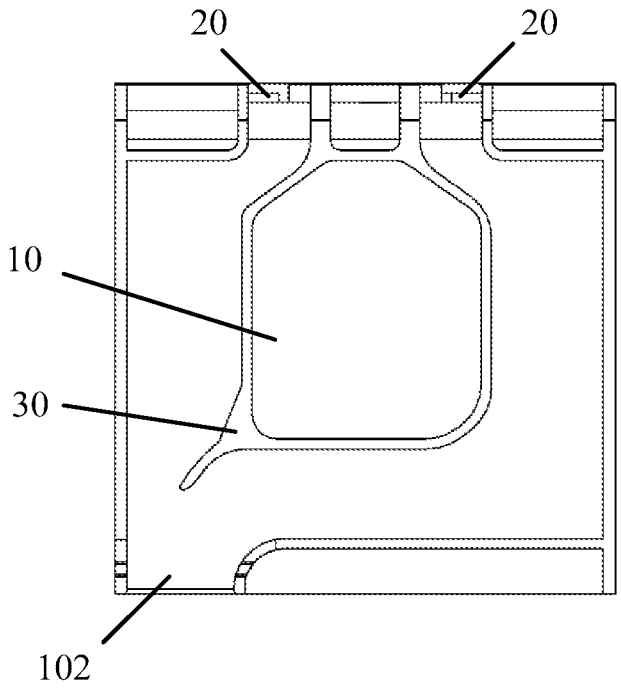
FIG. 2 is a schematic structural view of a cooking device in an embodiment of the present disclosure.

As shown in FIG. 1 to FIG. 6, the present disclosure provides an air duct assembly, comprising: a main body 10, and the main body 10 is provided with an air inlet 102 toward one side of the main body 10; a plurality of air outlets 20 formed in areas of two sides of the main body 10; an air-uniformizing partition plate 30 is provided on the main body 10 and located above the air inlet 102; The air-uniformizing partition plate 30 divides the air entered from the air inlet 102 into the areas of two sides of the main body 10 so that the air is discharged via the plurality of air outlets 20. The air outlets 20 on both sides of the structures in FIG. 1 and FIG. 2 are not shown.

According to the air duct assembly provided in the present disclosure, by providing the air uniformizing partition plate 30 above the air inlet 102, the air entered from the air inlet on one side of the main body 10 can be evenly divided to both sides of the air duct assembly by the air-uniformizing partition plate 30 so that the air is discharged via the air outlet 20. Due to an asymmetrical structure of the air duct, the inlet air is uniformly divided into the air outlets 20 on both sides by providing the air-uniformizing partition plate 30. Generally, the air outlet 20 communicates with an inner liner (refrigeration compartment) of the refrigerator 5, so that air volumes at the air inlets 102 on both sides of the refrigeration compartment are evenly distributed, which reduces temperature differences among different parts, reduces the occurrence of temperature fluctuations, and effectively reduces the flow resistance loss and aerodynamic noise, realizing greater flow at the same fan rotating speed. A top end of the air-uniformizing partition plate 30 may be a multi-section arc chamfer structure for further reducing aerodynamic resistance.

In one embodiment of the present disclosure, as shown in FIG. 1 to FIG. 6, the plurality of air outlets 20 comprises: a first air outlet 202, which is provided on a side of the main body 10 closer to the air inlet 102; a second air outlet 204, which is provided at a top of the main body 10 that is closer to the air inlet 102; a third air outlet 206, which is provided on a side of the main body 10 farther from the air inlet 102; a fourth air outlet 208, which is provided at a top of the main body 10 farther from the air inlet 102; and an deflecting plate 40, which is provided on the main body 10 and located between the third air outlet 206 and the air-uniformizing partition plate 30, and the deflecting plate 40 divides the inlet air farther from the air inlet into the third air outlet 206 and the fourth air outlet 208. The air outlets 20 on the sides of the structures in FIG. 1 and FIG. 2 are not shown.

In the embodiment, air outlets 20 are each provided on the side and the top of two sides of the main body 10 to ensure a more uniform air outlet for the refrigeration compartment, which is convenient to improve the cooling efficiency of a refrigeration device and avoid the temperature difference in the refrigeration compartment. At the same time, by providing the deflecting plate 40, the air flowing to the third air outlet 206 and the fourth air outlet 208 on the far side of the air inlet 102 is divided to ensure a more uniform air flow for the air flowing through the third air outlet 206 and the fourth air outlet 208, further avoiding the temperature difference in the refrigeration compartment, and also reducing air flow resistance loss and aerodynamic noise during the air dividing. This can improve the cooling capacity and uniformity of the refrigeration unit, while also reducing noise and improving the user experience.

Figure 3:
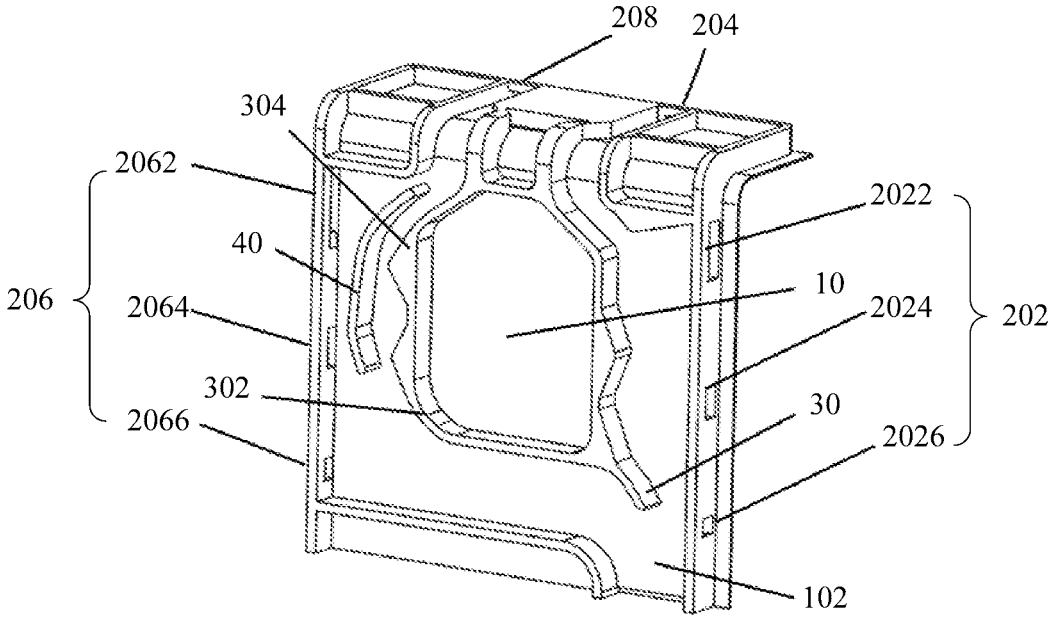
FIG. 3 is a schematic structural view of a cooking device in an embodiment of the present disclosure.
Figure 4:
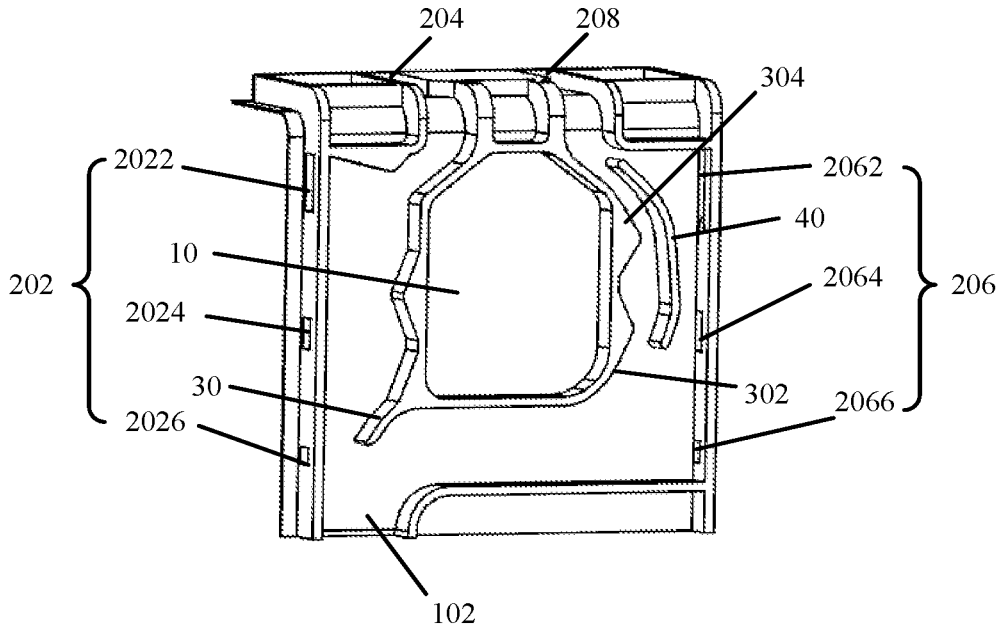
FIG. 4 is a schematic structural view of a cooking device in an embodiment of the present disclosure.
Figure 5:
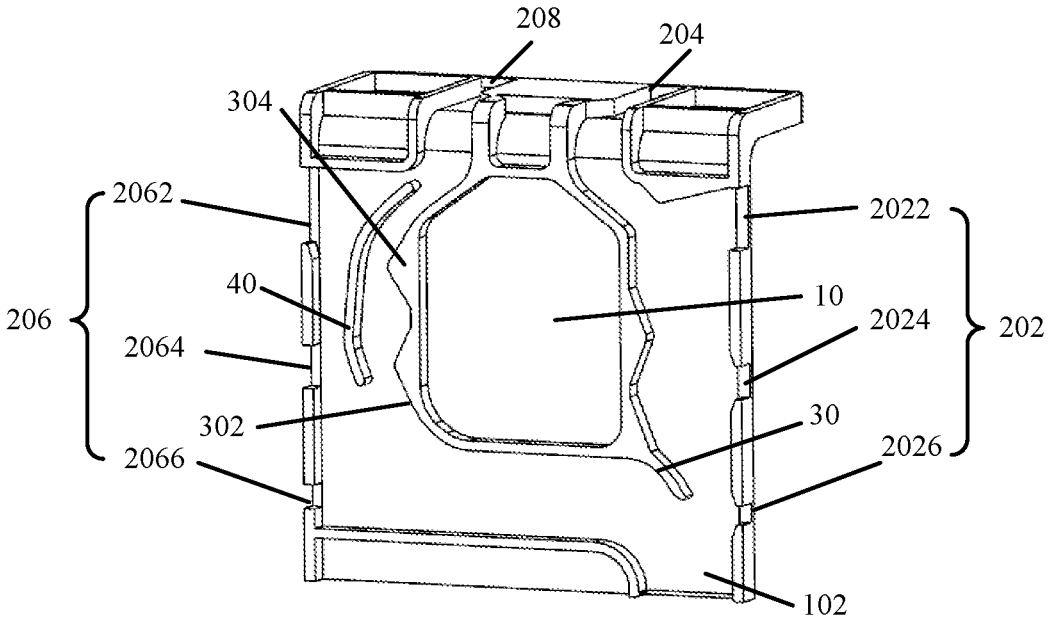
FIG. 5 is a schematic structural view of a cooking device in an embodiment of the present disclosure.
Figure 6:
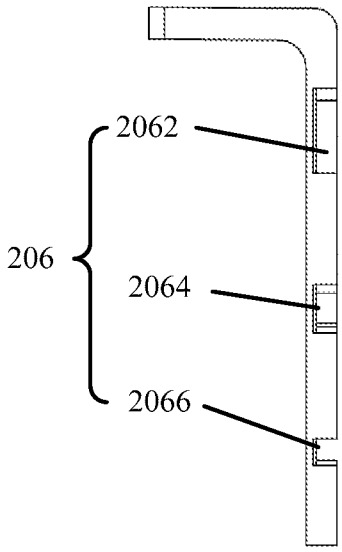
FIG. 6 is a side view of the structure shown in FIG. 5.

In one embodiment of the present disclosure, as shown in FIG. 3 to FIG. 5, the air-uniformizing partition plate 30 is provided with a round corner 302 at a bottom of a side close to the third air outlet 206.

In the embodiment, by providing the curved corner 302 at the bottom of the air-uniformizing partition plate 30 on the side close to the third air outlet 206, the airflow can smoothly flow through the curved corner 302 area when flowing to the side of the third air outlet 206. Therefore, the flow loss caused by the sudden change of air current is reduced, the occurrence unnecessary eddy current is reduced, the uniformity of air flowing to the third air outlet 206 and the fourth air outlet 208 is improved, and local temperature fluctuation is avoided.

In one embodiment of the present disclosure, as shown in FIG. 3 to FIG. 5, the air-uniformizing partition plate 30 is provided with a wavelike structure 304 or a zigzag structure at a side of the air-uniformizing partition plate 30 close to the third air outlet 206. The structures shown in FIG. 3 to FIG. 5 adopts the wavelike structure 304, and the zigzag structure may also be selected according to actual needs.

In the embodiment, generally, when the airflow encounters a curve, the flow direction changes, which will not only cause loss due to resistance, but also generate vortexes. However, by using the deflecting plate 40 in combination with the wavelike structure 304 or the zigzag structure, the airflow loss can be effectively reduced. The wavelike structure 304 or the zigzag structure can prevent a reverse airflow caused by the pressure difference, thereby avoiding the increase of resistance caused by the reverse airflow and the reduction of effective flow, reducing some of the noise caused by airflow vibrations, increasing the uniformity and effectiveness of the airflow, also increasing the amount of airflow that flows out the air outlet 20, so that the cooling efficiency is improved and energy saved.

In one embodiment of the present disclosure, as shown in FIG. 3 to FIG. 5, the third air outlet 206 comprises: a third upper air outlet 2062, provided at an upper portion of a side of the main body 10 farther from the air inlet 102; a third middle air outlet 2064, provided at a middle portion of a side of the main body 10 farther from the air inlet 102; and a third lower air outlet 2066, provided at a lower portion of a side of the main body 10 farther from the air inlet 102.

In the embodiment, the third air outlet 206 comprises three air outlets 20 at the upper, middle and lower sides of the side farther from the air inlet 102. By providing the upper, middle and lower air outlets 20, air discharge flow at each air outlet 20 can be more uniform, and local temperature difference and temperature fluctuation are avoided; and for the refrigeration compartment connected to the air outlet 20, a more uniform cooling effect can be obtained, so that the air temperature at each position inside the refrigeration compartment is kept substantially the same, the temperature fluctuation is suppressed, and the local temperature difference is avoided.

In one embodiments, as shown in FIG. 3 and FIG. 5, the bottom of the third upper air outlet 2062 is provided with a first air guiding slope, and an angle between the first air guiding slope and the horizontal plane ranges from 20° to 45°.

In the embodiment, the first air guiding slope is provided at the bottom of the third upper air outlet 2062 to divide the air at the third upper air outlet 2062, thereby reducing inlet resistance loss and increasing outlet air volume. Further, the outlet air volume at each air outlets 20 is more uniform, the cooling effect is more uniform, the local temperature difference is avoided, and the temperature fluctuation is eliminated.

In one embodiment, the distance between the third upper air outlet 2062 and the third middle air outlet 2064 ranges from 50 mm to 150 mm; the distance between the third lower air outlet 2066 and the third middle air outlet 2064 ranges from 50 mm to 150 mm.

In the embodiment, by providing a positional relationship among the third upper air outlet 2062, the third middle air outlet 2064, and the third lower air outlet 2066, the airflow passing through the air duct assembly can smoothly flow out from the air outlets at corresponding positions, thereby improving the efficiency of air flow and reducing pressure loss.

In one embodiment of the present disclosure, as shown in FIG. 3 to FIG. 5, the first air outlet 202 comprises: a first upper air outlet 2022, provided at an upper portion of a side of the main body 10 closer to the air inlet 102; a first middle air outlet 2024, provided at a middle portion of a side of the main body 10 closer to the air inlet 102; and a first lower air outlet 2026, provided at a lower portion of a side of the main body 10 closer to the air inlet 102.

In the embodiment, the first air outlet 202 comprises three air outlets at the upper, middle and lower sides of the side farther from the air inlet 102. By providing the upper, middle and lower air outlets, air discharge flow at each air outlet can be more uniform, and local temperature difference and temperature fluctuation are avoided; and for the refrigeration compartment connected to the air outlet, a more uniform cooling effect can be obtained, so that the air temperature at each position inside the refrigeration compartment is kept substantially the same, the temperature fluctuation is suppressed, and the local temperature difference is avoided.

In one embodiment, as shown in FIG. 5, the bottom and the top of the first middle air outlet 2024 are each provided with a second air guiding slope, and an angle between the second air guiding slope and the horizontal plane ranges from 20° to 30°. The bottom and the top of the first lower air outlet 2026 are each provided with a second air guiding slope, and an angle between the second air guiding slope and the horizontal plane ranges from 20° to 30°.

In the embodiment, the first air guiding slope is provided at the first middle air outlet 2024 and the bottom and top of the first lower air outlet 2026 to guide the air at the first middle air outlet 2024 and the first lower air outlet 2026, thereby increasing outlet air volume. Further, the outlet air volume among each air outlets 20 is more uniform, the cooling effect is more uniform, the local temperature difference is avoided, and the temperature fluctuation is suppressed.

In one embodiment, the distance between the first upper air outlet 2022 and the first middle air outlet 2024 ranges from 50 mm to 150 mm; and the distance between the first lower air outlet 2026 and the first middle air outlet 2024 ranges from 50 mm to 150 mm.

In the embodiment, by providing a positional relationship among the first upper air outlet 2022, the first middle air outlet 2024, and the first lower air outlet 2026, the airflow passing through the air duct assembly can smoothly flow out from the air outlets at corresponding positions, thereby improving the efficiency of air flow and reducing pressure loss.

In one embodiment, the thickness of the deflecting plate 40 ranges from 5 mm to 12 mm.

In the embodiment, by providing the deflecting plate 40 of a suitable thickness, the airflow can be well guided, making the flow at each air outlet 20 more uniform, and the resistance of the airflow will not be increased by the excessive thickness, which affects the airflow. Generally, the thickness of the deflecting plate 40 can be selected from 5 mm to 12 mm, and the thickness of the deflecting plate 40 can be adjusted according to the actual structure of the air duct and the airflow.

In one embodiment, the thickness of the air-uniformizing partition plate 30 ranges from 5 mm to 12 mm. and the ratio of the thickness of the air-uniformizing partition plate 30 to a cross-sectional width of the air inlet 102 ranges from 5% to 15%.

In the embodiment, by providing the air-uniformizing partition plate 30 of a suitable thickness, the airflow can be well guided, making the flow at each air outlet 20 more uniform, and the resistance of the airflow will not be increased by the excessive thickness, which affects the airflow. Generally, the thickness of the air-uniformizing partition plate 30 can be selected from 5 mm to 12 mm or 5% to 15% of the cross-sectional width of the air inlet 102. In this way, the diversion of the inlet 102 air at the air inlet can be achieved without causing a relatively large resistance to the airflow, and in practical applications, the thickness of the air-uniformizing partition plate 30 can also be adjusted according to the actual structure of the air duct and the airflow.

Figure 7:
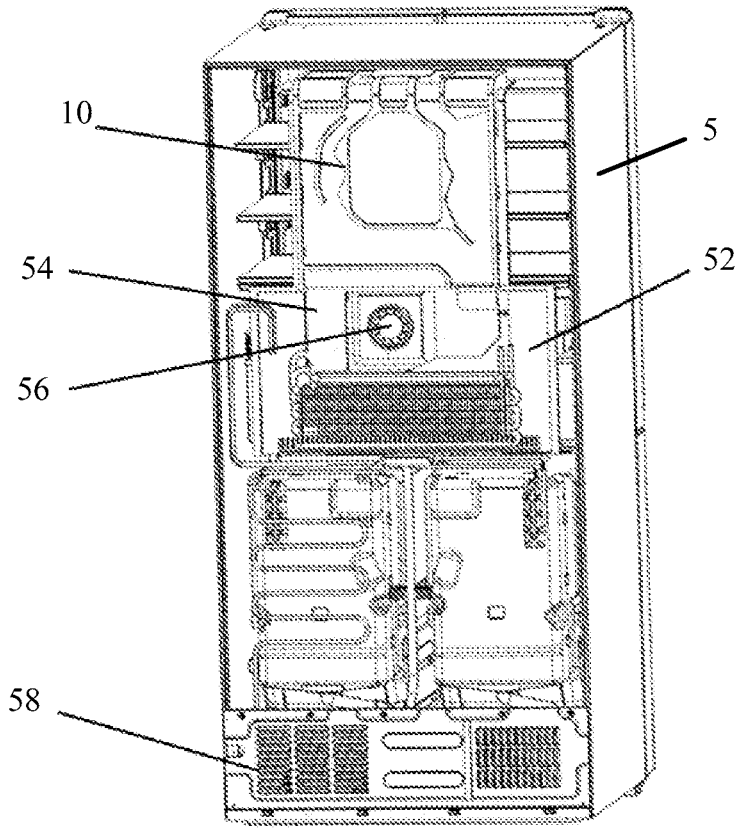
FIG. 7 is a rear view of the refrigerator in an embodiment of the present disclosure.
Figure 8:
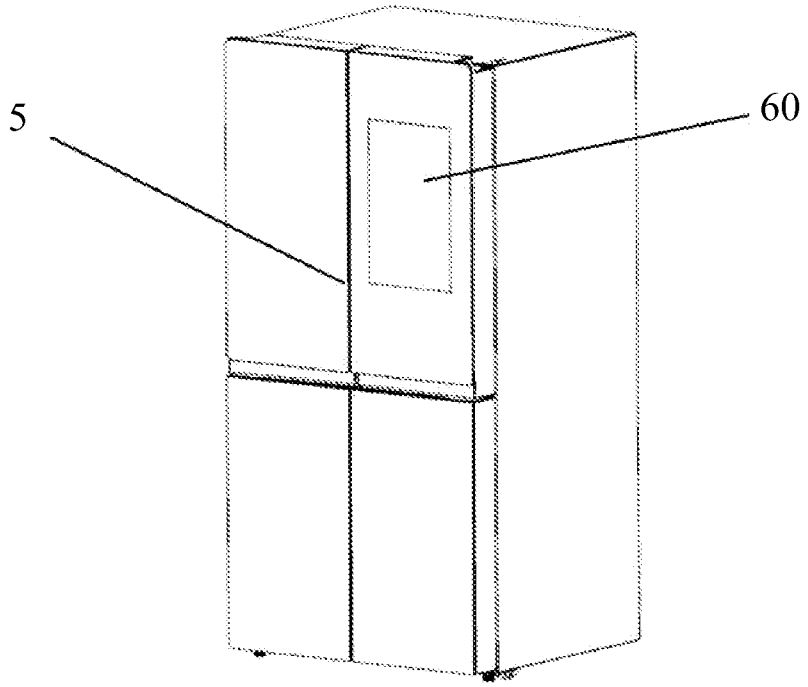
FIG. 8 is a perspective view of a refrigerator in an embodiment of the present disclosure.

A refrigerator 5 is also provided in embodiments of the disclosure, as shown in FIG. 7 and FIG. 8. The refrigerator 5 provided in the present disclosure comprises the air duct assembly of the embodiments.

The refrigerator 5 provided in the present disclosure adopts the air duct assembly of the embodiments of the present disclosure. Generally, the air outlet 20 communicates with an inner liner (refrigeration compartment) of the refrigerator 5, so that air volumes at the air inlets 102 on both sides and the top of the refrigeration compartment are evenly distributed, which reduces temperature differences among different parts, reduces the occurrence of temperature fluctuations, and effectively reduces the flow resistance loss and aerodynamic noise, realizing greater flow at the same fan rotating speed, improving the efficiency of the refrigerator 5 and saving energy.

The refrigerator 5 shown in FIG. 7 comprises a front cover assembly 52, a rear cover assembly 54, a fan assembly 56, and a compressor compartment 58 (a compressor is provided in the compressor compartment). The refrigeration system of the refrigerator 5 is constituted by the above-mentioned components and components of the air duct assembly of embodiments of the disclosure. By providing the air duct assembly of the present disclosure, the air cooled by the refrigeration system can flow more uniformly to the refrigerating compartment of the refrigerator 5, improving the cooling effect and user experience of the refrigerator 5.

A control display screen 60 is provided on a refrigerator 5 door of the refrigerator 5 shown in FIG. 8, and the user can set a preset cooling temperature of the refrigerator 5 through the control display screen 60. By providing the air duct assembly of embodiments of the present disclosure, the refrigeration efficiency of the refrigerator 5 is improved, so that the refrigeration compartment can reach the preset temperature more quickly, and the energy consumption of the refrigerator 5 is saved.

In addition, other refrigeration equipment such as a freezer, an air conditioner, and the like may also adopt the air duct assembly provided in the present disclosure, so that the outlet air volume thereof is more uniform, avoiding uneven outlet air volume and temperature fluctuation due to asymmetry of the air duct structure, as well as energy consumption waste caused by the resistance to the air of the structure.

In one embodiment of the disclosure, as shown in FIG. 7, the refrigerator further comprises: a fan assembly 56, the fan assembly 56 being connected to the air duct assembly.

In the embodiment, the low temperature air flowing out of the fan assembly 56 flows uniformly to each air outlet through the air duct assembly, which reduces pressure loss and aerodynamic noise, and achieves a better cooling effect under the condition that the fan assembly 56 has a certain amount of air supply.

In one embodiment of the disclosure, the refrigerator further comprises: a refrigeration compartment, the refrigeration compartment being connected to the plurality of air outlets.

In the embodiment, the low temperature air flowing out through the plurality of air outlets flows into the refrigeration compartment, and by adopting the above air duct assembly, the air inlet in the refrigeration compartment is more uniform, and the uniform cooling in the compartment is ensured, avoiding local temperature rise caused by uneven airflow and thus affect food storage.

In the present disclosure, the term "plurality" means two or more, unless specifically defined otherwise. The terms "installation," "connection," "connected," and "fixed" should be understood broadly. For example, the "connection" may be a fixed connection, a detachable connection, or an integral connection; "connected" may be directly connected or indirectly connected through an intermediate medium.

Reference throughout this specification to "one embodiment", "some embodiments", "specific embodiments" and the like means that the specific features, structures, materials or characteristics described in connection with the embodiment or example is included in at least some embodiments of the present disclosure. In the present specification, schematic representations of the above terms are not necessarily referring to the same embodiment or example. Meanwhile, the particular features, structures, materials or characteristics may be combined in any suitable manner with one or more other embodiments.

What is claimed is:

1. An air duct assembly, comprising:

a main body, the main body being provided with an air inlet, wherein the air inlet is provided below the main body and toward a corner of the main body;

a plurality of air outlets formed in areas surrounding the main body; and an air-uniformizing partition plate provided on the main body with a protruding portion extending toward the air inlet;

wherein the air-uniformizing partition plate divides the air entered from the air inlet into the areas surrounding the main body and the air is discharged via the plurality of air outlets;

wherein the plurality of air outlets comprise:

a first air outlet provided on a first side of the main body closer to the air inlet;

a second air outlet provided at a top of the main body closer to the air inlet;

a third air outlet provided on a third side of the main body far from the air inlet;

a fourth air outlet provided at the top of the main body far from the air inlet; and a deflecting plate provided between the third air outlet and the main body;

wherein the deflecting plate divides the air from the air inlet into the third air outlet and the fourth air outlet.

2. The air duct assembly according to claim 1, wherein, the air-uniformizing partition plate is provided with a round corner at a bottom of a side close to the third air outlet.

3. The air duct assembly according to claim 1, wherein, the air-uniformizing partition plate is provided with at least one of a wavelike structure or a zigzag structure on a side close to the third air outlet and on a side close to the first air outlet.

4. The air duct assembly according to claim 3, wherein the third air outlet comprises:

a third upper air outlet, provided at an upper portion of a side of the main body farther from the air inlet;

a third middle air outlet, provided at a middle portion of a side of the main body farther from the air inlet;

a third lower air outlet, provided at a lower portion of a side of the main body farther from the air inlet.

5. The air duct assembly according to claim 4, wherein, a bottom of the third upper air outlet is provided with a first air guiding slope, and an angle between the first air guiding slope and the horizontal plane ranges from 20° to 45°.

6. The air duct assembly according to claim 4, wherein, a distance between the third upper air outlet and the third middle air outlet ranges from 50 mm to 150 mm;

a distance between the third lower air outlet and the third middle air outlet ranges from 50 mm to 150 mm.

7. The air duct assembly according to claim 3, wherein the first air outlet comprises:

a first upper air outlet, provided at an upper portion of a side of the main body closer to the air inlet;

a first middle air outlet, provided at a middle portion of a side of the main body closer to the air inlet;

a first lower air outlet, provided at a lower portion of a side of the main body closer to the air inlet.

8. The air duct assembly according to claim 7, wherein, the bottom and the top of the first middle air outlet are each provided with a second air guiding slope, and an angle between the second air guiding slope and the horizontal plane ranges from 20° to 30°, the bottom and the top of the first lower air outlet are each provided with a third air guiding slope, and an angle between the third air guiding slope and the horizontal plane ranges from 20° to 30°.

9. The air duct assembly according to claim 7, wherein, a distance between the first upper air outlet and the first middle air outlet ranges from 50 mm to 150 mm;

a distance between the first lower air outlet and the first middle air outlet ranges from 50 mm to 150 mm.

10. The air duct assembly according to claim 1, wherein, a thickness of the deflecting plate ranges from 5 mm to 12 mm.

11. The air duct assembly according to claim 1, wherein, a thickness of the air-uniformizing partition plate ranges from 5 mm to 12 mm; or the ratio of the thickness of the air-uniformizing partition plate to a cross-sectional width of the air inlet ranges from 5% to 15%.

12. A refrigerator, comprising:

an air duct assembly, comprising:

a main body, the main body being provided with an air inlet, wherein the air inlet is provided below the main body and toward a corner of the main body;

a plurality of air outlets formed in areas surrounding the main body; and an air-uniformizing partition plate provided on the main body with a protruding portion extending toward the air inlet;

wherein the air-uniformizing partition plate divides the air entered from the air inlet into the areas surrounding the main body and the air is discharged via the plurality of air outlets;

wherein the plurality of air outlets comprise:

a first air outlet provided on a first side of the main body closer to the air inlet;

a second air outlet provided at a top of the main body closer to the air inlet;

a third air outlet provided on a third side of the main body far from the air inlet;

a fourth air outlet provided at the top of the main body far from the air inlet; and a deflecting plate provided between the third air outlet and the main body;

wherein the deflecting plate divides the air from the air inlet into the third air outlet and the fourth air outlet.

13. The refrigerator according to claim 12, wherein the refrigerator further comprises:

a fan assembly, the fan assembly being connected to the air duct assembly.

14. The refrigerator according to claim 12, wherein the refrigerator further comprises:

a refrigeration compartment, the refrigeration compartment being connected to the plurality of air outlets.

* * * * *